United States Patent [19]

Morrison

[11] Patent Number: 4,986,066

[45] Date of Patent: Jan. 22, 1991

[54] VACUUM SPINNING NOZZLE ASSEMBLY

[75] Inventor: Elbert F. Morrison, Clarksville, Va.

[73] Assignee: Burlington Industries, Inc., Greensboro, N.C.

[21] Appl. No.: 483,994

[22] Filed: Feb. 22, 1990

Related U.S. Application Data

[63] Continuation of Ser. No. 286,293, Dec. 19, 1988, abandoned.

[51] Int. Cl.[5] ..... D01H 1/115

[52] U.S. Cl. ..... 57/333; 57/5; 57/328; 57/343

[58] Field of Search ..... 57/333, 334, 341, 343, 57/403, 411, 5, 328

[56] References Cited

U.S. PATENT DOCUMENTS

| | | | |
|---|---|---|---|
| Re. 31,705 | 10/1984 | Morihashi | 57/224 |
| 2,302,790 | 11/1942 | Modigliani | 57/333 X |
| 3,043,088 | 7/1962 | Breen | 57/333 X |
| 3,458,987 | 8/1969 | Ozawa et al. | 57/333 X |
| 3,702,055 | 11/1972 | Kosaka et al. | 57/333 X |
| 4,322,944 | 4/1982 | Sraitr et al. | 57/343 X |
| 4,468,921 | 9/1984 | Shibata et al. | 57/333 |
| 4,507,913 | 4/1985 | Morrison | 57/328 |
| 4,631,912 | 12/1986 | Hardy | 57/279 |
| 4,635,435 | 1/1987 | Morrison et al. | 57/328 |
| 4,689,948 | 9/1987 | Bahov et al. | 57/333 X |
| 4,693,071 | 9/1987 | Morrison | 57/289 |
| 4,713,931 | 12/1987 | Morrison et al. | 57/328 |
| 4,719,744 | 1/1988 | Morrison | 57/5 |
| 4,827,710 | 5/1989 | Nishimura | 57/328 |
| 4,845,932 | 7/1989 | Sakai et al. | 57/5 |

FOREIGN PATENT DOCUMENTS

| | | |
|---|---|---|
| 63-85123 | 4/1988 | Japan . |
| 143050 | 10/1971 | U.S.S.R. . |

*Primary Examiner*—Joseph J. Hail, III

[57] ABSTRACT

Method and apparatus are disclosed relating to forming yarn by "vacuum spinning". A spinning nozzle assembly is provided which includes two axially aligned sections, each formed with a through passageway. Adjacent facing surfaces of the sections define a continuous radial slot through which air flow may be directed. The axially aligned sections of the nozzle are, in one exemplary embodiment, telescopically received within a sleeve mounted for rotation within a housing. The nozzle sections may be adjusted axially relative to each other to alter the dimension of the radial slot as desired, for example, in accordance with a predetermined yarn count.

29 Claims, 1 Drawing Sheet

VACUUM SPINNING NOZZLE ASSEMBLY

This is a continuation of application Ser. No. 07/286,293, filed Dec. 19, 1988, now abandoned.

BACKGROUND AND SUMMARY OF THE INVENTION

In U.S. Pat. No. 4,507,913 which is incorporated herein by reference, and in commonly owned U.S. Pat. Nos. 4,713,931 and 4,719,744, methods and apparatus are provided for efficiently and effectively producing yarn having properties approaching those of ring spun yarn, but at much greater speeds. The basic technique disclosed in said patents is known as "vacuum spinning", and it has a number of advantages compared to conventional techniques, as described in the above mentioned commonly owned patents. Improved vacuum spinning nozzle designs are disclosed in commonly owned U.S. Pat. No. 4,635,435.

The apparatus and method according to the present invention have substantially all of the same advantages described above with respect to vacuum spinning in general. In accordance with the present invention, a unique vacuum spinning nozzle is provided which has even further advantages.

In earlier vacuum spinning nozzle designs, one particularly satisfactory arrangement incorporates four orifice holes which radially communicate with the nozzle main passageway and through which an outward flow of air is created to draw some of the fibers up into the interior of the orifices momentarily, before they are wrapped about the remaining core fibers as the yarn continues its forward motion.

In one exemplary embodiment of the present invention, a vacuum spinning nozzle assembly is provided which comprises separable male and female cone sections axially aligned and slidably received within a peripheral sleeve. The composite male and female cone sections are formed with a longitudinally extending through passageway which includes a tapered inlet in the female cone section and an axially aligned and relatively straight portion extending through the male cone section. A radially outwardly extending, continuous conical slot is defined by facing, tapered surfaces of the female and male cone sections, the width dimension of which slot may be altered by relative axial movement of the male and/or female cone sections.

In use, a sliver is fed linearly into the tapered entry passageway of the female cone section of the nozzle assembly, and passed into the straight passageway portion of the male cone section. As the sliver fibers pass the radially outwardly directed slot, an applied or induced vacuum causes some surface fibers of the sliver to be drawn into the slot. As the fibers continue passage through the nozzle assembly, these displaced surface fibers will be pulled back from the slot and wrapped about the remaining core fibers as the nozzle assembly rotates about its longitudinal axis, which coincides with the direction of linear movement of the fibers.

It has been found that the ability to change the width dimension of the conical slot has beneficial effects in the production of yarns of different texture. For example, a relatively smaller slot provides better results for finer yarns whereas a relatively larger slot provides better results for coarser yarns.

Thus, in a related aspect, the present invention relates to methods of forming yarn by vacuum spinning wherein the conical slot dimension is altered in accordance with the desired yarn count.

Another advantage accrues by reason of the fact that a wider slot does not clog with fiber extractions such as vegetable matter, dirt, etc. as sometimes happens with the known multiple orifice arrangement.

The presently disclosed nozzle configuration also produces a yarn with a somewhat smoother surface, with less fiber bundles, while yarn strength is substantially equal to yarn produced with the conventional four orifice nozzle arrangement. It is therefore the primary object of the present invention to provide effective refinements and modifications of methods and apparatus for vacuum spinning of yarn. This and other objects of the invention will become apparent from the detailed description which follows.

DETAILED DESCRIPTION OF THE DRAWINGS

Figure 1:
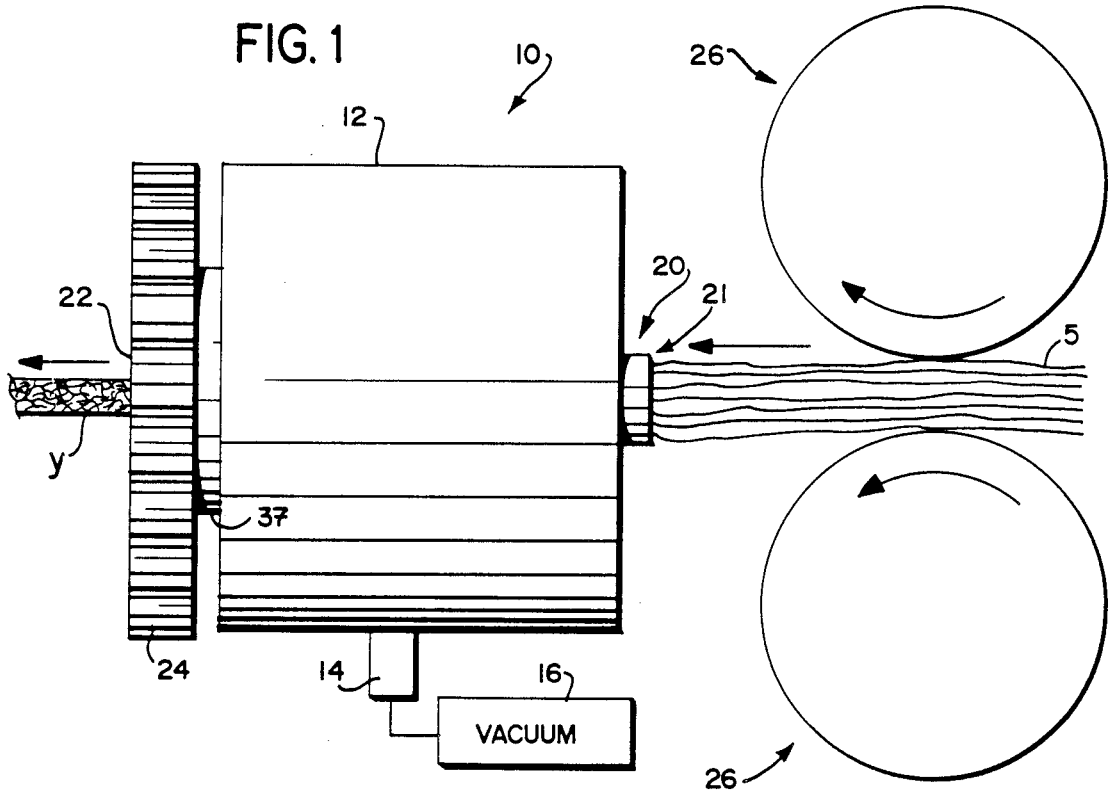
FIG. 1 is a side view of exemplary apparatus according to the present invention, shown in schematic cooperation with a vacuum source and feed rollers.

Basic apparatus for vacuum spinning is shown in commonly assigned U.S. Pat. Nos. 4,507,913; 4,713,931 and 4,719,744. The particular apparatus and procedures according to the present invention provide further refinements and modifications of the prior vacuum spinning techniques, particularly in the forming of yarn from sliver.

The apparatus 10 comprises an outer housing 12 of metal, ceramic, or other suitable material which is operatively connected through an integral nipple 14 to suitable means for establishing a vacuum in the housing, such as a vacuum pump 16 (shown schematically) which preferably provides about 16–20 inches of mercury. The interior of the housing 12 is hollow, and is adapted to enclose a shaft or nozzle 20 for rotation therein. The nozzle includes a first inlet end 21 thereof and a second outlet end 22. At the outlet end 22, a gear 24 is mounted, which is connected to appropriate other gears and/or drives (not shown) for effecting rotation of the nozzle 20 within the housing. The drive means can rotate the nozzle 20 either clockwise or counter clockwise to provide either a Z or S wrap direction or twist as desired.

From a conventional draft system (not shown in the drawings, but described in, for example, U.S. Pat. No. 4,719,744) a sliver S (or roving) passes through the nip of the front feed rolls 26, through the rotating nozzle, and exits the outlet end 22.

Figure 2:
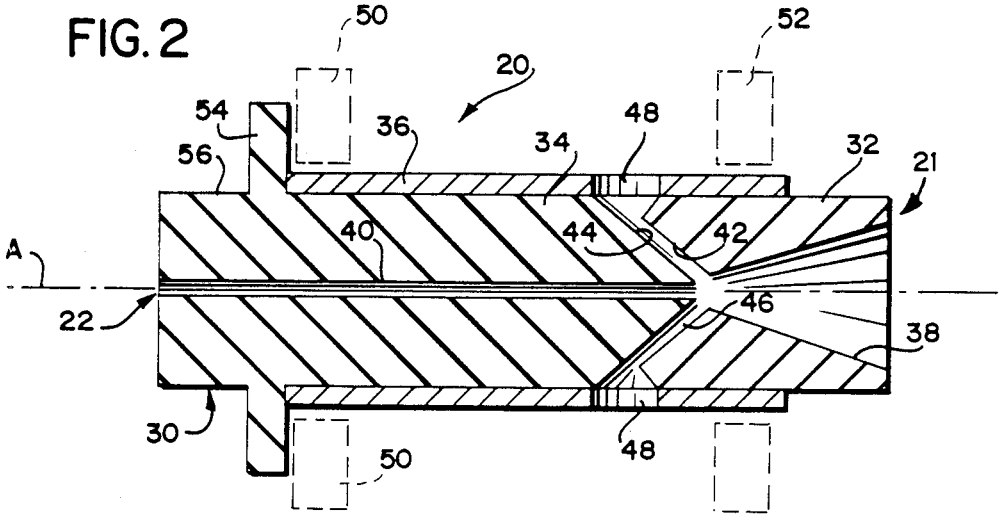
FIG. 2 is side cross-sectional view of an exemplary nozzle for use with the vacuum spinning apparatus of FIG. 1.

A preferred nozzle assembly 20 according to the present invention is shown in detail in FIG. 2. It comprises an elongated hollow shaft 30, having a substantially cylindrical shape, which comprises the composite of a female cone section 32 and a male cone section 34 which are held in close association by a cylindrical sleeve 36 slidably received over the male and female cone sections in telescoped relation thereto. A through-extending passageway is formed in the nozzle assembly which extends from the first end 21 to the second end 22. This passageway includes a first conical or tapered portion 38 in the female cone section 32 and a relatively straight portion 40 of substantially circular cross-section which extends completely through the male cone section 34. It will be appreciated that passageway portions 38 and 40 are in axial alignment relative to a longitudinal axis of rotation A passing through the nozzle assembly, and corresponding to the linear direction of movement of the fibers.

The female cone section 32 is provided with a tapered radial surface 42 extending from the narrowed portion of passageway 38 radially outwardly to the periphery of the section. A complementary and adjacent radial surface 44 is provided on the male cone section 34 which also extends from the passageway 40 to the outer periphery of the section. The adjacent tapered surfaces 42, 44 define a continuous radial slot 46 extending from the juncture of passageway portions 38, 40 to the periphery of the nozzle assembly 20 in a direction inclined upwardly toward the outlet end 22 of the nozzle assembly 20.

Sleeve 36 is provided with apertures or slots 48 which overlie the slot 46 so that communication is established between the interior of the nozzle assembly and the interior of the housing 12, thereby permitting a vacuum to be drawn through the slot from within the interior of the housing.

Bearings 50, 52 (shown in phantom) are provided for mounting the assembled composite shaft 30, and sleeve 36 for rotation in the housing 12. An annular flange 54 extends radially away from the male cone section 34 near the second end 22, and the bearing 50 is shown to abut this flange. A portion 56 of the shaft lying to the outside of flange 54 is adapted to receive the gear 24 by a press-fit or other attachment means. The gear 24 may be operatively connected to suitable drive means (not shown) for effecting rotation of the composite shaft 30 and sleeve 36 relative to the housing 12. Any other suitable means for rotating the shaft may also be employed.

It will be appreciated that the separable nozzle assembly comprising male and female cone sections 32, 34 slidably received within the sleeve 36, permits adjustment of the width dimension of the radial slot 46.

In operation, relative axial movement between the male and female cone sections is effected until the desired slot dimension is achieved, depending on whether fine or coarse yarn is to be formed. It will be appreciated that a suitable chart or the like can be arranged to aid the machine operator in selecting the appropriate slot dimension based on, for example, yarn count. After the appropriate slot dimension has been set, a sliver or roving S is fed through feed rolls 26 into the tapered conical inlet portion 38 of the nozzle passageway. As the sliver passes the radially outwardly extending conical slot 46, some 15–30% of the fibers are drawn into the slot 46 by reason of the flow of air from the first end 21 outwardly through the slot by the vacuum created by pump 16. It will be understood, of course, that other suitable means may be employed to create an air flow directed outwardly through the slot 46. For example, establishing a flow of air under pressure along the exterior of the shaft, across the slot 46 would effectively induce a vacuum within the slot for diverting the fibers as previously described. The fibers are pulled back from the slot and wrapped around the main or core mass of fibers, forming a yarn as the nozzle assembly 20 rotates within the housing 12. After exiting the nozzle, the yarn is wound or further processed in conventional fashion.

The principal advantage of the above described nozzle design is, as noted above, the ability to alter the width dimension of the conical slot 46 by effecting relative axial movement between the male and female cone sections 32, 34 within the sleeve 36. It has been determined in this regard, that different slot sizes provide better results for various types of yarn. For example, a slot gap or width dimension, i.e., the distance between surfaces 42, 44 of 0.040–0.050 inch provides better results for finer yarn counts of 1/60–1/30 (worsted system), whereas a slot gap dimension of 0.060–070 inch provides better results for coarser yarns of $\frac{1}{8}$ count for example. In addition, it appears that yarn elongation is superior to yarn produced with a four orifice arrangement as previously described.

Variations of the above-described nozzle assembly are also within the scope of this invention. For example, surface 44 of the male cone sections may be roughened or textured, by serrating or knurling, etc., in order to produce certain desired effects on yarn appearance, strength and elongation. For example, the surface 44 may be grooved perpendicular to the apex of the cone to thereby affect the manner in which the surface fibers are wrapped about the remaining core fibers.

In another variation of the nozzle design, the direction of the conical slot can be reversed, i.e., the male surface 44 made concave, and the female cone surface 42 made convex, resulting in a steeper angle of the fibers drawn back out of the slot, putting additional pressure on the wrapper fibers, and resulting in more tightly wound wrapper fibers.

In still another arrangement, sleeve 36 may be shortened axially to enclose only the male cone section 34, while the female cone section 32 is fixed within the housing 12 by any suitable means. Thus, the female cone section may be held stationary, while male cone section 34 is both slidable and rotatable relative thereto. It is believed that effective wrapping of fibers will nevertheless take place as a result of the rotation only of the male cone section 34.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for forming yarn comprising:

a housing;

an elongated shaft assembly mounted for rotation within said housing and having an inlet end and an outlet end, said shaft assembly further comprising first and second axially aligned sections relatively moveable toward and away from each other along an axis, at least one of said first and second axially aligned sections mounted for rotation about said axis within said housing;

an axial passageway extending through said first and second axially aligned sections;

a continuous, annular slot defined by opposed surfaces of said first and second sections and extending radially outwardly from said passageway, said slot having a width dimension adjustable by relative axial movement between said first and second sections; and means for establishing an air flow radially outward through said annular slots.

2. Apparatus according to claim 1, wherein said first shaft section comprises a female cone section, and said second shaft section comprises a male cone section.

3. Apparatus according to claim 2 wherein the axial passageway extending through the female cone section tapers inwardly from an entry end to a first surface which at least partially defines said radially extending slot.

4. Apparatus according to claim 3 wherein said first surface which at least partially defines said radially extending slot is inclined away from said inlet end and toward said outlet end.

5. Apparatus according to claim 2 wherein the axial passageway extending through the male cone section is substantially uniformly circular in cross-section and is substantially coincident with said axis of rotation.

6. Apparatus according to claim 5 wherein said male cone section includes a second surface which at least partially defines said radially extending slot, said second surface being inclined away from said inlet end and toward said outlet end.

7. Apparatus according to claim 6 wherein said first and second surfaces are substantially parallel.

8. Apparatus according to claim 1 wherein said first and second sections are telescopically received within a sleeve, and wherein said sleeve is mounted for rotation about said axis.

9. Apparatus according to claim 1 wherein at least one of said first and second portions are telescopically received within a sleeve and said sleeve is mounted for rotation about said axis.

10. A vacuum spinning nozzle for use in manufacturing yarn from sliver or roving or for manufacturing roving from sliver comprising:

a housing having a hollow interior;

a shaft assembly mounted for rotation in said housing about an axis, said shaft assembly having an inlet end and an outlet end and comprising axially aligned male and female sections mounted for relative movement toward and away from each other and provided with a through passageway extending from said inlet end to said outlet end, said male and female sections further defining a continuous radial slot extending between said passageway and said hollow interior of said housing, said slot being adjustable to a predetermined width by reason of said relative movement, wherein said housing includes means for operative connection to air flow means to induce an air flow radially outward through said slot.

11. A vacuum spinning nozzle according to claim 10 and further including a hollow sleeve telescopically received over at least said male section of said shaft assembly.

12. A vacuum spinning nozzle according to claim 10 and further including a hollow sleeve telescopically received over both of said male and female sections of said shaft assembly.

13. A vacuum spinning nozzle according to claim 10 wherein said through passageway includes a conical entry surface in said female section and a substantially constant diameter bore in said male section.

14. A vacuum spinning nozzle according to claim 10 wherein first and second surfaces of said female and male sections, respectively, form said continuous radial slot, said first and second surfaces extending radially outwardly in a direction inclined with respect to said axis.

15. A vacuum spinning nozzle according to claim 14 wherein at least one of said first and second surfaces is rough.

16. A vacuum spinning nozzle according to claim 14 wherein at least one of said first and second surfaces is rough.

17. Apparatus for forming yarn comprising:

a housing;

an elongated shaft assembly mounted for rotation within said housing and having an inlet end and an outlet end, said shaft assembly comprising first and second axially aligned sections relatively moveable toward and away from each other along an axis and rotatable about said axis, wherein said first shaft section comprises a female cone section and said second shaft section comprises a male cone section;

an axial passageway extending through said first and second axially aligned sections;

a continuous, annular slot defined by said first and second sections and extending radially outwardly from said passageway, and wherein said continuous, radially extending slot may be enlarged or reduced in size by axial adjustment of one or the other of the male and female cone sections;

means for establishing an air flow radially outward through said annular slot; and means for rotating said elongated shaft assembly.

18. Apparatus according to claim 17 wherein the axial passageway extending through the female cone section tapers inwardly from an entry end to a first surface which at least partially defines said radially extending slot.

19. Apparatus according to claim 18 wherein said first surface which at least partially defines said radially extending slot is inclined away from said inlet end and toward said outlet end.

20. Apparatus according to claim 17 wherein the axial passageway extending through the male cone section is substantially uniformly circular in cross-section and is substantially coincident with said axis of rotation.

21. Apparatus according to claim 20 wherein said male cone section includes a second surface which at least partially defines said radially extending slot, said second surface being inclined away from said inlet end and toward said outlet end.

22. Apparatus according to claim 21 wherein said first and second surfaces are substantially parallel.

23. Apparatus according to claim 17 wherein said first and section sections are telescopically received within a rotatable sleeve.

24. Apparatus according to claim 17 wherein at least one of said first and second portions are telescopically received within a rotatable sleeve.

25. A vacuum spinning nozzle for use in manufacturing yarn from sliver or roving or for manufacturing roving from sliver comprising:

a housing having a hollow interior;

a shaft assembly mounted for rotation in said housing about an axis, said shaft assembly having an inlet end and an outlet end and comprising axially separable male and female sections provided with a through passageway extending from said inlet end to said outlet end, said male and female sections further provided with complementary surfaces defining a continuous radial slot extending between said passageway and said hollow interior of said housing, wherein said housing includes means for operative connection to air flow means to induce an air flow radially outward through said slot; and a drive element mounted on one of said male and female sections for effecting rotation of said shaft assembly.

26. A vacuum spinning nozzle according to claim 25 and further including a hollow sleeve telescopically received over at least said male portion of said shaft assembly.

27. A vacuum spinning nozzle according to claim 25 and further including a hollow sleeve telescopically received over both of said male and female sections of said shaft assembly.

28. A vacuum spinning nozzle according to claim 25 wherein said through passageway includes a conical entry surface in said female section and a substantially constant diameter bore in said male section.

29. A vacuum spinning nozzle according to claim 25 wherein said complementary surfaces extend radially outwardly in a direction inclined with respect to said axis.

* * * * *